United States Patent [19]

Teasdale

[11] Patent Number: 4,969,595

[45] Date of Patent: Nov. 13, 1990

[54] CONVERTIBLE DISTRIBUTION AND CARRY-OUT CARTON

[75] Inventor: Arthur C. Teasdale, Sun Prairie, Wis.

[73] Assignee: Oscar Mayer Foods Corporation, Madison, Wis.

[21] Appl. No.: 383,006

[22] Filed: Jul. 21, 1989

[51] Int. Cl.[5] ..... B65D 5/10

[52] U.S. Cl. ..... 229/117.17; 229/117.16; 229/172; 229/904; 206/459; 206/562

[58] Field of Search ..... 229/103, 117.16, 117.17, 229/172, 174, 175, 178, 904; 206/232, 541, 561, 562, 565, 459

[56] References Cited

U.S. PATENT DOCUMENTS

| | | | |
|---|---|---|---|
| 2,229,425 | 1/1941 | Tanner | 229/174 |
| 2,665,050 | 1/1954 | Baumann | 229/174 |
| 2,675,166 | 4/1954 | Main | 229/174 |
| 2,944,723 | 7/1960 | Marino et al. | 229/175 |
| 3,253,766 | 5/1966 | Coe | 229/904 |
| 3,324,998 | 6/1967 | Farquhar | 229/904 |
| 3,640,380 | 2/1972 | Huffman | 229/904 |
| 3,687,354 | 8/1972 | Jennings | 229/174 |
| 4,037,777 | 7/1977 | Maughan | 229/165 |
| 4,497,433 | 2/1985 | Wischusen, III | 229/904 |
| 4,511,042 | 4/1985 | Wischusen, III | 229/904 |
| 4,562,926 | 1/1986 | Mode | 229/904 |
| 4,572,423 | 2/1986 | Spencer | 229/904 |
| 4,705,173 | 11/1987 | Forbes, Jr. | 229/904 |

FOREIGN PATENT DOCUMENTS

| | | | |
|---|---|---|---|
| 508205 | 12/1954 | Canada | 229/904 |

*Primary Examiner*—David T. Fidei

*Attorney, Agent, or Firm*—Joseph T. Harcarik

[57] ABSTRACT

A carton and blank therefor are provided with components for easily and efficiently converting a carton from one suitable for distribution of bulk goods to a carry-out tray which may include a plurality of configurations, each of which, in order to be properly implemented, requires removal from the carton of the legend indicating that the contents of the bulk goods distribution carton had been inspected and approved by, for example, a governmental agency.

15 Claims, 3 Drawing Sheets

FIG. 5
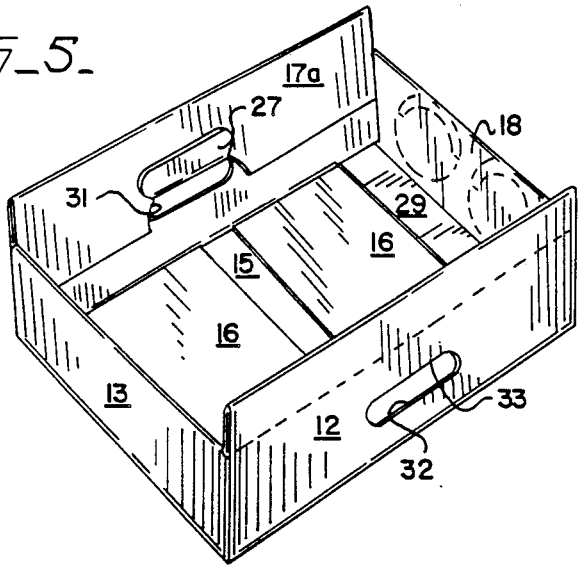
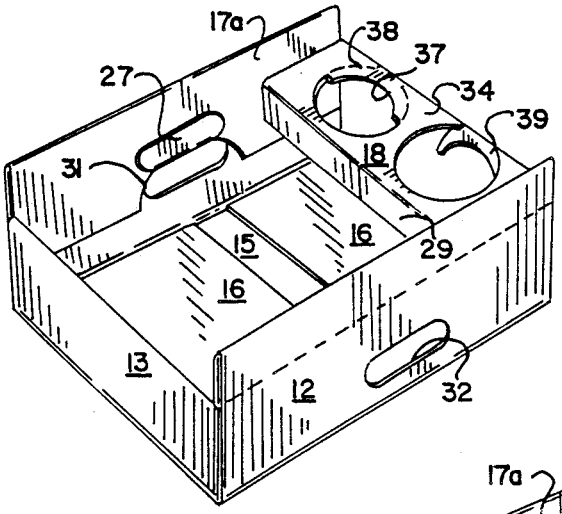
FIG. 6
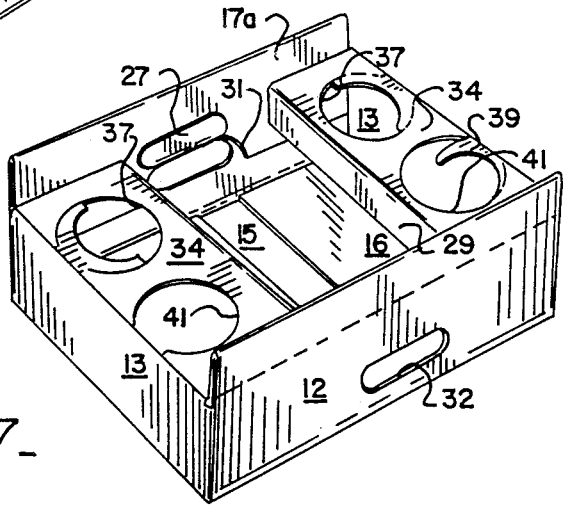
FIG. 7

CONVERTIBLE DISTRIBUTION AND CARRY-OUT CARTON

BACKGROUND AND DESCRIPTION OF THE INVENTION

The present invention generally relates to carton structures which are convertible from a familiar distribution carton configuration to one or more configurations of a carry-out tray. An inspection approval legend is positioned on a component of the carton which must be removed during modification thereof from its distribution carton configuration to any of its carry-out tray configurations. It is important to ensure removal of the inspection approval legend. While it must be present to distribute the goods therewithin when it is used as a distribution carton, proper use of the carton as a carry-out tray requires modification of the carton so as to remove the inspection approval legend, which is not necessarily germane to the items within the carton when it is in a carry-out tray configuration.

In many retail sales operations which perform some assembly tasks on commodities in order to provide retail customers with finished goods, cartons that are used to package components prior to assembly into the finished goods will be saved and used as a tray for assisting in transporting groupings of finished goods by the customer. This often occurs, for example, in retail food outlets wherein packages for items such as bread, buns, meats, vegetable products and the like are reused as transport trays for sandwiches, drinks and the like. In a typical situation, these packaging containers are not especially well suited for use as finished product transport trays. Many of them are made of rather thin stock or they are not particularly well configured for securely holding items which are precarious to balance. At times, features are incorporated into cartons in an attempt to render them more suitable for use as transport trays for finished goods.

Under circumstances such as these, it has been observed that distribution packaging which is made of heavier weight paperboard materials would provide some added stability when used as a transport tray, even for diverse goods such as sandwiches and drinks in disposable cups and the like. Generally speaking, at least when it comes to prepared food operations, these heavier weight paperboard containers are supplied by wholesalers of government inspected products such as meats and other processed or raw food products that are inspected and subjected to approval certification, which certification is stamped, printed or otherwise substantially permanently attached at an obvious location on the exterior of the carton. That inspection certification or the like is specific to some attribute of the bulk product which is packaged in wholesale quantities and received by the retail establishment. Because of this, packages of this type are not truly suitable for reuse as a transport tray which provides packaging for items that have not in fact been inspected and approved or have been handled and repackaged since inspection and approval. Accordingly, there is typically a valid concern which is founded in proper use of inspection and approval legend or indicia which discourages reuse of certain cartons that otherwise have solid potential for profitable reuse, including multiple reuses when the customer returns the tray to the retailer. Instead, these cartons are discarded and often other cartons specially designed as transport trays are used in place thereof, thereby creating additional waste products which must be handled for proper disposal or the like.

With this general background in mind, it can be seen that certain advantages are to be gained by providing some means by which the heavier weight paperboard bulk goods cartons can be easily and efficiently transformed into stable carry-out trays that can handle diverse finished or prepared goods such as hot or cold sandwiches or other food items and hot or cold drinks and the like. Included are appropriate means by which inspection indicia such as government agency approval legends or stampings and the like must be removed from the packaging in order to fully transform same into a carry-out tray device.

In summary, the bulk goods distribution carton and blank according to the present invention are convertible into a carry-out tray having one or more carry-out configurations which, when properly implemented, require the person converting same from a distribution carton to a carry-out tray to remove an inspection and/or approval seal or the like which is otherwise prominently displayed on the outside surface when the carton is in its bulk goods distribution configuration. Preferably, the means for conversion of the distribution carton into the carry-out tray provides the converter with the option of forming multiple-function drink supporting structures.

It is accordingly a general object of the present invention to provide an improved convertible paperboard carton and blank therefor.

Another object of this invention is to provide an improved convertible carton and blank therefor which allow conversion from a bulk goods distribution carton to a carry-out tray.

Still a further object of the present invention is to provide an improved bulk goods distribution carton and blank therefor having an arrangement whereby indicia such as government inspection seals must be removed from the distribution carton when it is converted to a carry-out tray.

These and other objects, features and advantages of the present invention will be clearly understood through a consideration of the following detailed description.

BRIEF DESCRIPTION OF THE DRAWINGS

In the course of this description, reference will be made to the attached drawings, wherein:

FIG. 5 is a perspective view illustrating the carry-out tray configuration which is in process as shown in FIG. 4;

FIG. 6 is a perspective view illustrating another carry-out tray configuration; and FIG. 7 is a perspective view showing a further carry-out tray configuration of the carton blank shown in FIG. 1.

DESCRIPTION OF THE PARTICULAR EMBODIMENTS

Figure 1:
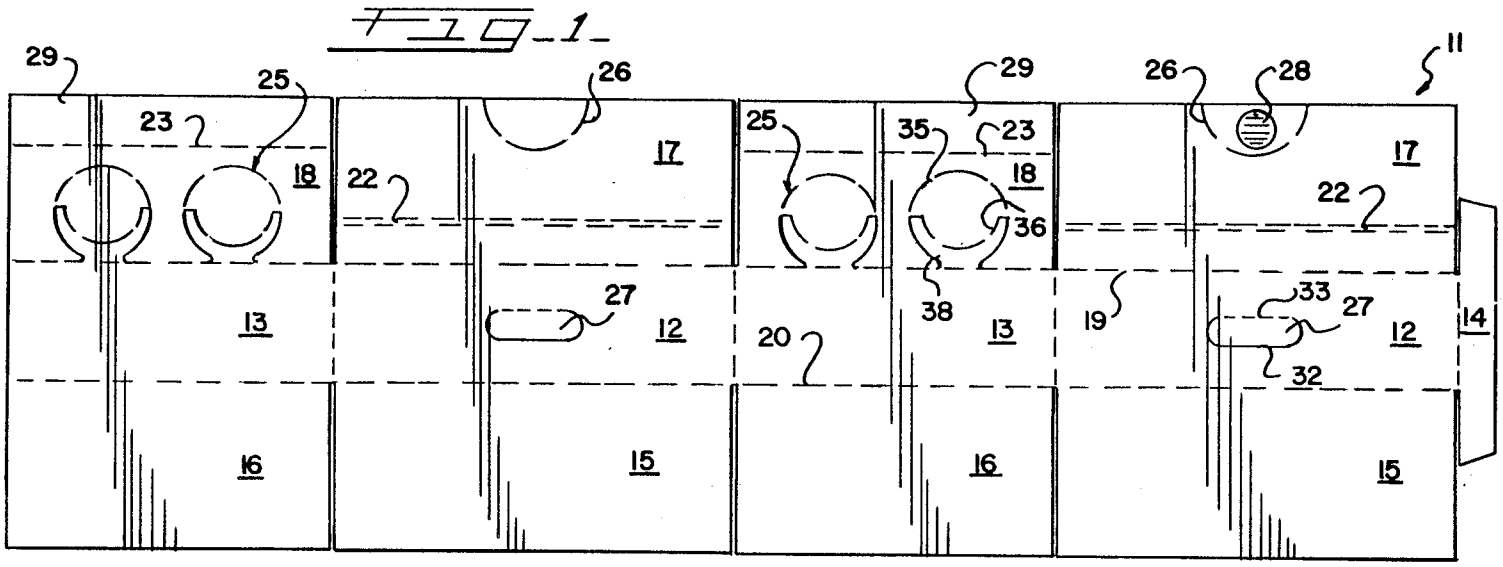
FIG. 1 is a plan view of an individual carton blank as cut and scored for the construction of a convertible carton according to the present invention.
Figure 2:
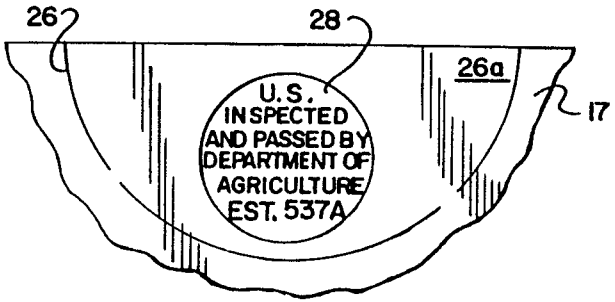
FIG. 2 is an enlarged detail view of an inspection approval indicia on the carton blank illustrated in FIG. 1.

The basic carton structure which is illustrated in the drawings is formed from a blank, generally designated as 11, of paperboard or similar foldable sheet material and has a generally typical overall construction. Included are sidewall panels 12 and end wall panels 13. A tab 14 is provided for adhesively joining or otherwise securing edges of panels 12, 13 together in order to provide upstanding walls or sides of a container made from the blank 11. Bottom flaps 15, 16 are provided for forming a closed bottom of the carton in a well-known manner.

Top flaps 17 and 18 have an outside configuration which is typically similar to that of the bottom flaps 15, 16. In addition, these top flaps 17, 18, in cooperation with portions of the remainder of the carton formed from the blank 11, include various die cuts and/or score lines for providing the various carton configurations of the blank 11.

Substantially continuous score lines 19 and 20 provide foldable demarcations between the wall panels 12, 13 and the bottom flaps 15, 16, as well as with the top flaps 17, 18. Score lines 22, which are preferably in the form of double score lines that are parallel and closely spaced from each other, are provided in top flaps 17. Fold lines 23, which can take the form of score creases or perforated die cuts, may be included in each of top flaps 18. Combination arcuate die cuts, generally designated as 25, may be positioned along top flaps 18. An edge die cut 26 is included in each of the top flaps 17. A corresponding handle member 27 is located in each sidewall panel 12.

Figure 3:
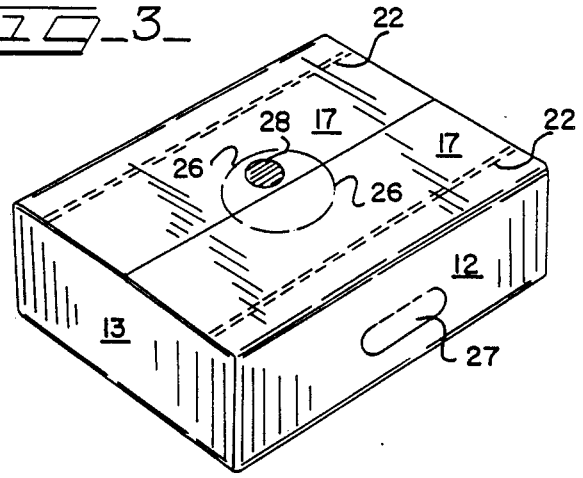
FIG. 3 is a perspective view of a blank as illustrated in FIG. 1 which is folded and assembled into a bulk goods distribution carton.

FIG. 3 illustrates blank 11 which has been folded to have a carton configuration suitable for bulk goods distribution. Such a carton will typically be packaged with fresh or processed items such as food items. Particular examples in this regard include sliced cold cuts or luncheon meat slices which may, for example, be individually packaged in a number of three pound stacks or the like. This is typically the form in which such food products or the like are packaged by the meat processor or the like for shipment to retail store operations, such as those equipped to combine these sliced meat products or the like into sandwich type products. Although score lines 22, edge die cuts 26 and handle member 27 can be seen when the blank is used as distribution carton, as shown in FIG. 3, each such die cut or fold line will preferably remain unaltered from its form on the blank 11 so that the carton remains intact for shipment and storage. It will be noted that an inspection approval legend or indicia 28 is prominently displayed on the top of the carton.

Figure 4:
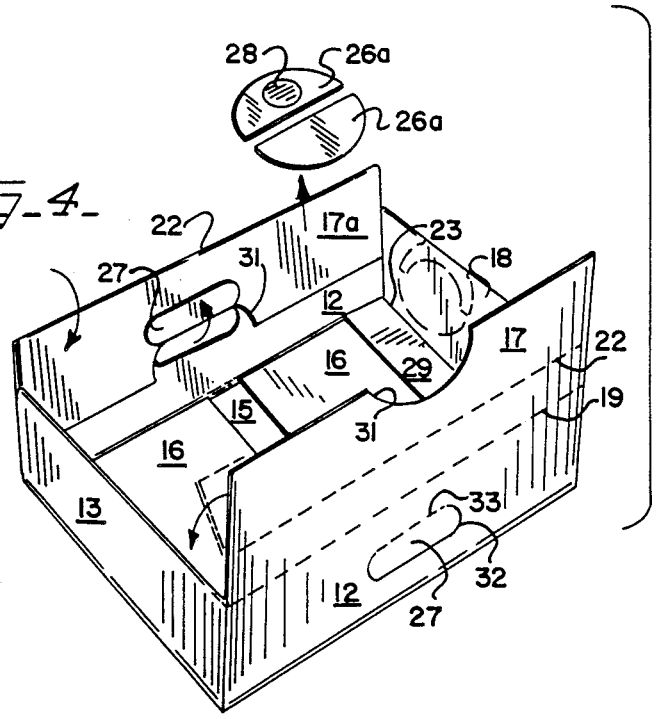
FIG. 4 is a perspective, somewhat exploded view illustrating steps for conversion of the bulk goods distribution carton into a carry-out tray.

As viewed in FIG. 4, all of the bulk goods have been removed from the carton, and the carton is in the process of being converted into a carry-out tray. Each top flap 18 is folded over and down into the carton or tray. As can be seen in the illustrated embodiment, the width of each top flap 18 is greater than the depth of the carton or tray, as indicated by the height of the end wall panel 13; accordingly, an edge 29 of each top flap 18 is folded so as to rest on the inside surface of each bottom flap 16. With this orientation, a tray having maximum volume is provided.

The tray formed after completion of the steps shown in FIG. 4 is illustrated in FIG. 5. These steps include unfolding score lines 19 and folding the outer section of each top flap 17 down and over into the tray, as illustrated by the two arrows in FIG. 4 in order to thereby form inside flap 17*a*. Each inside flap 17*a* closely overlies the inside of each sidewall panel 12. Flap 17*a* is secured thereto by cooperation between individual components thereof. More specifically, each edge die cut 26 is punched completely through, typically by digital forces, in order to thereby remove punch-out panels 26*a* which are then discarded, thereby forming an indent 31. Indent 31 provides clearance for movement of handle member 27 inwardly. More specifically, die cut perforations 32 and score line 33 define the handle member 27, which is punched out along the die cut perforation 32 and folded up along the score line 33 in the manner illustrated in FIG. 4. Thus, it will be seen that the punch-out panels 26*a* must be removed from the carry-out tray in order for the carry handles to be formed therein. It is virtually impossible to successfully form the handles without first punching out the panels 26*a*. Accordingly, the inspection approval legend or indicia 28 is no longer included in the carry-out tray, thereby eliminating any concerns that the indicia 28 could be intended to apply to the contents of the carry-out tray.

It will be noted that the spacing of the score line 22 away from the normal fold line 19 of each of the top flaps 17 causes the formation of an upstanding lip having the score area 22 as its free longitudinal edge. This not only increases the capacity of the carry-out tray, but it also provides the needed alignment of the punched-in handle member 27 with the indent 31. It also ensures substantial clearance between the free edge of the inside flap 17*a* and the bottom of the carton tray.

The carry-out tray configuration illustrated in FIG. 5 would be particularly suitable, for example, for transporting a large quantity of food items. For example, same may be sized to hold so-called foot long submarine sandwiches in an orientation generally between the handles 27. The maximum number of such food items will be accommodated by the configuration illustrated in FIG. 5. With the configuration shown in FIG. 6, particular means are provided for supporting cups or the like containing drinks, while the FIG. 7 carry-out tray configuration will specifically support, for example, twice as many cups by the generally duplicative structure as shown in FIG. 6.

With more specific reference to these cup-supporting structures, the top flap 18 is unfolded to the extent that it forms a shelf 34, and the edge 29 is folded generally downwardly in order to provide added support for the shelf 34 in the form of a generally vertically inclined support leg 29 which frictionally engages the opposing inside flaps 17*a*.

Concerning the combination arcuate die cuts 25 on each shelf 34, in the orientations illustrated in FIGS. 6 and 7, they are positioned for selective punch-out in order to receive a cup therewithin. In the illustrated embodiment, a smaller cup is accommodated by severance along score arcs 35 and 36 in order to form an opening 37 as shown in FIGS. 6 and 7. When a larger cup is to be accommodated, a supplemental score arc 37 is likewise severed, at least to the extent that a crescent-shaped member 38 is moved away in order to form a larger opening 41.

It will thus be seen that the present invention provides a new and useful convertible carton and blank therefor, which carton and blank have a number of advantages and characteristics, including those pointed out herein and others which are inherent in the invention. Preferred embodiments of the invention have been described by way of example, and it is anticipated that modifications may be made to the described form without departing from the spirit of the invention or the scope of the appended claims.

I claim:

1. A bulk goods distribution carton having inspection indicia thereon which is convertible from a distribution carton configuration wherein the distribution carton is substantially closed to at least one carry-out tray configuration wherein the carry-out tray is substantially open and wherein the inspection indicia is removed from said carton, the carton comprising:

sidewall and end wall panels joined together in a generally alternating manner for forming an upstanding peripheral wall of a carton;

bottom flap means for forming a substantially closed bottom wall of the carton, said bottom flap means being secured to respective edges of said sidewall and end wall panels;

top flap means moveable between the distribution carton configuration wherein the top flap means is substantially closed and the at least one carry-out tray configuration wherein the top flap means is substantially open;

said top flap means forming a substantially closed top wall of the carton when the top flap means is in its said distribution carton configuration; and said top flap means and said upstanding peripheral wall cooperate, when the carton is in said carry-out tray configuration, to provide handle means for grasping the carton and for ensuring removal of said inspection legend indicia from said carton, said top flap means remaining open in said at least one carry-out tray configuration, said handle means including an edge die cut defining a punch-out panel which, once removed, forms an indent along an edge of a component of said top flap means, said handle means further including a punch-out and fold-over handle member in said sidewall panel, whereby when said top flap means is folded generally onto itself within the carton, said folded handle member engages said indent, and whereby said folding and engagement is substantially prevented when said punch-out panel is in place, and wherein said inspection legend indicia is included on said punch-out panel.

2. The convertible carton according to claim 1, wherein said folded over top flap is folded over along a line spaced away from and generally parallel to the edge at which same is secured to said respective edge of the sidewall panel, in order to thereby define an upstanding lip which includes a doubled-over portion of the top flap.

3. The convertible carton according to claim 1, wherein said folded over top flap means is folded over along a line spaced away from and generally parallel to the edge at which same is secured to said respective edge of the sidewall panel, in order to thereby define an upstanding lip which includes a doubled-over portion of the top flap means.

4. The convertible carton according to claim 1, wherein said top flap means further includes shelf means for supporting cups and the like, said shelf means including a shelf member generally parallel to said substantially closed bottom wall, said shelf means further including an edge member that frictionally engages a portion of said top flap means which is folded over onto itself.

5. The convertible carton according to claim 1, further including shelf means for supporting cups and the like, said shelf means including a shelf member generally parallel to said substantially closed bottom wall, said shelf means further including an edge which engages said folded over top flap means of the handle means.

6. The convertible carton according to claim 4, wherein said shelf means includes arcuate die cut means for providing arcuate openings, one having a larger area than the other.

7. The convertible carton according to claim 5, wherein said shelf means includes arcuate die cut means for providing arcuate openings, one having a larger area than the other.

8. An elongated blank of sheet material which is cut and scored for forming a bulk goods distribution carton having an inspection legend indicia thereon and which is convertible into at least one open carry-out tray configuration, said blank being thus divided into a plurality of sidewall and end wall panels having bottom flap means and top flap means secured thereto at scored edge locations of said sidewall and end wall panels, wherein said blank comprises:

said bottom flap means forming a substantially closed bottom wall when the blank is assembled into the carton, said top flap means forming a substantially closed top wall when the blank is assembled into the carton having a distribution carton configuration, and said top flap means forming a generally open area when the carton is in the at least one carry-out tray configuration; and said blank including handle means for facilitating carrying of the carton in said at least one one carry-out tray configuration and for ensuring removal of the inspection legend indicia during punch-out operations required for implementing said handle means, said handle means including cut and/or scored components in at least one of said sidewall panels and in at least one panel of said top flap means, said handle means including an edge die cut defining a punch-out panel which, once removed, forms an indent along an edge of a component of said top flap means, said handle means further including a punch-out and fold-over handle member in said sidewall panel, whereby when said top flap means is folded generally onto itself within the carton, said folded handle member engages said indent, and whereby said folding and engagement is substantially prevented when said punch-out panel is in place, and wherein said inspection legend indicia is included on said punch-out panel.

9. The convertible carton blank according to claim 8, wherein said top flap means includes score line weakening means for folding a top flap over onto itself in order to form an upstanding lip portion which extends beyond the sidewall panel to which said top flap is secured.

10. The convertible carton blank according to 8, wherein said top flap means includes weakening line means for forming a tray area and a downwardly folded edge portion for frictionally engaging another portion of said top flap means which is folded over onto itself.

11. The convertible carton blank according to claim 9, wherein said top flap means further includes weakening line means for forming a downwardly folded edge portion for frictionally engaging said top flap means which is folded over onto itself.

12. The convertible carton blank according to claim 8, wherein said top flap means includes combination arcuate die cuts for providing at least two arcuate openings, one arcuate opening being larger than the other arcuate opening.

13. The convertible carton blank according to claim 10, wherein said tray area of the top flap means includes combination arcuate die cuts for providing at least two arcuate openings, one arcuate opening being larger than the other arcuate opening.

14. The convertible carton blank according to claim 8, wherein said sheet material is paperboard.

15. The convertible carton blank according to claim 8, wherein said sheet material is a semi-rigid material.

* * * * *